United States Patent [19]

Katayama

[11] Patent Number: 4,721,297

[45] Date of Patent: Jan. 26, 1988

[54] SHEET FEEDER

[75] Inventor: Kazunori Katayama, Chofu, Japan

[73] Assignee: Tokyo Juki Industrial Co., Ltd., Tokyo, Japan

[21] Appl. No.: 844,666

[22] Filed: Mar. 27, 1986

[30] Foreign Application Priority Data

Mar. 30, 1985 [JP] Japan ..... 60-67562

[51] Int. Cl.[4] ..... B65H 5/00

[52] U.S. Cl. ..... 271/10; 271/242; 271/266; 400/625; 400/636.2

[58] Field of Search ..... 400/636, 636.2, 624, 400/625, 629, 185, 187; 271/10, 111, 121, 122, 125, 3.1, 3, 4, 114–116, 242, 266

[56] References Cited

U.S. PATENT DOCUMENTS 3,032,338 5/1962 Anderson et al. ..... 271/125

4,509,734 4/1985 Rutishauser ..... 400/625

4,577,849 3/1986 Watanabe ..... 271/10

FOREIGN PATENT DOCUMENTS 48406 6/1984 Japan ..... 271/10

36238 2/1985 Japan ..... 271/121

*Primary Examiner*—H. Grant Skaggs

*Attorney, Agent, or Firm*—Morgan & Finnegan

[57] ABSTRACT

A paper sheet feeder includes an input roller, an interposed roller, an output roller and a motor. The interposed roller serves both as a paper-feeder and a paper-stopper by changing the drive direction of the motor. A one-way clutch is provided at the interposed roller and is effective to allow the roller both to stop the paper and to drive the paper. The input roller is also provided with a one-way clutch. A single motor effects both sheet removal from a pile and sheet feeding.

4 Claims, 4 Drawing Figures

SHEET FEEDER

BACKGROUND OF THE INVENTION

The invention relates to sheet feeders and more particularly to sheet feeders for supplying sheets of material such as paper to office copying and printing machines and the like.

Many types of sheet feeders are used in office supply equipment. For example, paper sheet feeders are widely used in copying machines and printers. In such machines, single sheets of paper are taken from a pile of paper, and the single sheets of paper are fed one by one to a photo drum or to a printer. The individual sheets are then correctly positioned. In some machines, mispositioned or misaligned sheets are simultaneously adjusted by using a plunger-type solenoid which shutters the flow of paper to stop the sheets physically at a preset point. Such sheet feeding devices are well-known.

Referring to FIG. 4, one example of a conventional sheet feeder used for feeding papers to a photo drum in an electro-photographic copying machine will be explained.

In the embodiment of FIG. 4, 41 denotes a sheet of paper, 42 denotes a paper cassette, and 43 denotes a feed roller. The embodiment of FIG. 4 further comprises transfer rollers 44, 44', 47, 47', and a shutter 45 which pivots by the action of a solenoid plunger 46 about support point 45*a* in the direction of the rotating arrow shown in FIG. 4. The paper 41 is fed by the feed roller 43 from the cassette 42 along guide plates G and is stopped temporarily by the shutter 45 as the front edge of the paper contacts the shutter 45. The paper 41 is then fed to the photo drum as needed (photo drum not shown).

Under the above conventional configuration, since a solenoid plunger was used, the total cost of the conventional machine, including the solenoid electric circuit, was high. Furthermore, when thin paper was fed, the thin paper was often easily bent and wrinkled by the shutter or the shutter operation. Additionally, when the shutter 45 opened as described above, bent paper could accidentally slip or otherwise be advanced beyond the shutter, and due to this over-slipping or advancement, the paper would be often mispositioned.

It is therefore an object of the invention to eliminate the above-described demerits of conventional sheet feeders and to propose a sheet feeder which is low in cost, secures stable feeding and prevents or corrects mispositioned paper.

SUMMARY OF THE INVENTION

These and other objects of the invention are met by providing a sheet feeder, including a feeder roller which removes a sheet from a pile, and an interposed roller provided along the sheet feeding course. Shafts for both the interposed roller and the feed roller are provided with one-way clutches in such a manner that the interposed roller also serves as a paper stopper or positioner. The one-way clutches allow a single motor to drive both the feed roller and the interposed roller to, respectively, remove the sheets from the pile, to stop the paper and to feed the sheet to a platen.

BRIEF DESCRIPTION OF THE DRAWINGS

The invention will be described in greater detail below by way of reference to the accompanying drawings, in which.

DETAILED DESCRIPTION OF THE DRAWINGS

The invention will be explained hereafter referring to the accompanying drawings.

Figure 1:
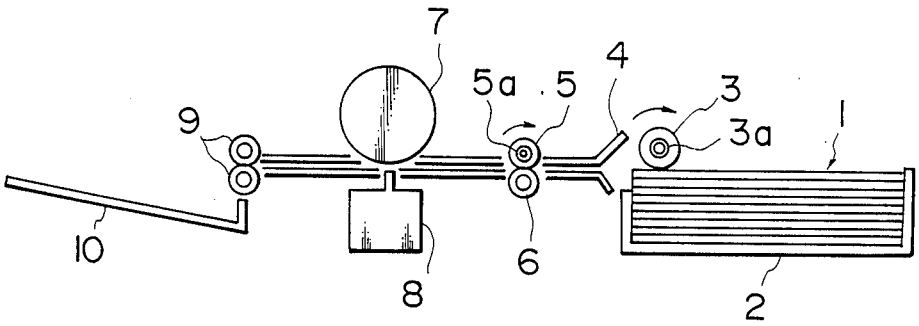
FIG. 1 is a schematic illustration of a paper feeder according to the invention.

FIG. 1 illustrates a dot-printer in which a sheet feeder according to the invention is applied. In FIG. 1, numeral 1 denotes a paper pile stored in a cassette 2. Numeral 3 denotes a feed roller which removes a sheet of paper placed at the top of the paper pile 1 and feeds the sheet of paper. Also illustrated in FIG. 1 are a guide plate 4, an interposed roller 5 which contacts with an auxiliary roller 6, a platen 7, a print head 8, an outlet roller 9 which delivers the printed paper, and a stacker 10 for stacking the printed paper.

Figure 2:
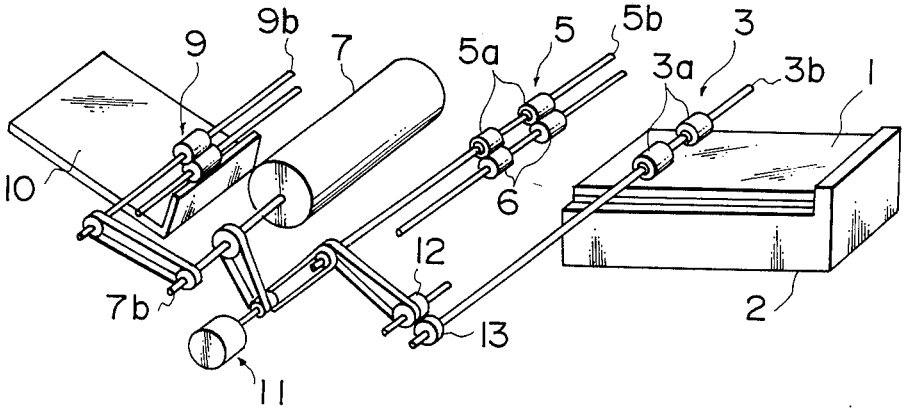
FIG. 2 is a perspective drawing of an embodiment of the invention according to FIG. 1.

FIG. 2 is a perspective view of the embodiment of FIG. 1, the same numerals being applied to corresponding parts in both drawings. Referring to FIG. 2, the platen 7, the feed roller 3, the interposed roller 5, and the outlet roller 9 are driven by a motor 11 via shafts 7*b*, 3*b*, 5*b* and 9*b*, respectively, through associated gears and timing belts.

In the embodiment of FIGS. 1 and 2 the rotational directions of the feed roller 3 and the interposed roller 5 are established to be opposite to each other. This is accomplished in this embodiment by setting gears 12, 13 facing each other, and by providing each roller 3, 5 with a one-way clutch 3*a*, 5*a*, respectively, inserted between the rollers 3,5 and each of the rollers' shafts 3*b*, 5*b*, respectively. The one-way clutches 3*a*, 5*a* may be of the one-way, overrunning flywheel clutch types.

Under the above configuration, referring to FIG. 2., when the motor 11 rotates counter-clockwise, the feed roller 3 rotates clockwise and feeds a sheet of paper which is at the top of the stack 1 on cassette 2 through the guide plate 4 (FIG. 1) to the interposed roller 5 to the auxiliary roller 6 where the movement of the paper is stopped by the roller 5. The movement of the paper stops at roller 5 because while the shaft 5*b* rotates counter-clockwise, the one-way clutch 5*a* does not transmit this counter-clockwise rotation to the interposed roller 5. Thus, it may be seen that in this embodiment shaft 5*b* rotates both clockwise and counter-clockwise whereas roller 5 rotates only clockwise.

As a next step, the motor 11 rotates clockwise, thereby causing the interposed roller 5 to rotate clockwise feeding the sheet of paper to the platen 7. At this time, the shaft 3*b* rotates counter-clockwise, but the one way clutch 3*a* does not transmit this counter-clockwise rotation to the feed roller 3. The feed roller 3 rotates clockwise and there is friction between the feed roller 3 and the paper 1. Thus, it may be seen that shaft 3*b* rotates both clockwise and counter-clockwise whereas roller 3 rotates only clockwise. As illustrated in FIG. 2, the motor 11 may also be adapted to turn a platen 7.

Rollers 5 and 6 form a wedge-shape therebetween. Since the paper 1 is stopped temporarily by the interposed roller 5 and the auxiliary roller 6 at the wedge-shaped junction, the paper 1 is stopped in rectitude and thus the deflection, wrinkling or slanted insertion of paper, as often experienced in conventional shutter-type paper stopping apparatuses, are eliminated, and accurate positioning of the paper is thereby secured.

Further, in the foregoing embodiment of the invention, only one motor 11 is used to drive the paper feed roller 3, the interposed roller 5, the outlet roller 9 and the platen 7. Since only one such motor is used to operate these components, the cost of such embodiments may be much reduced compared with conventional apparatuses.

Figure 3:
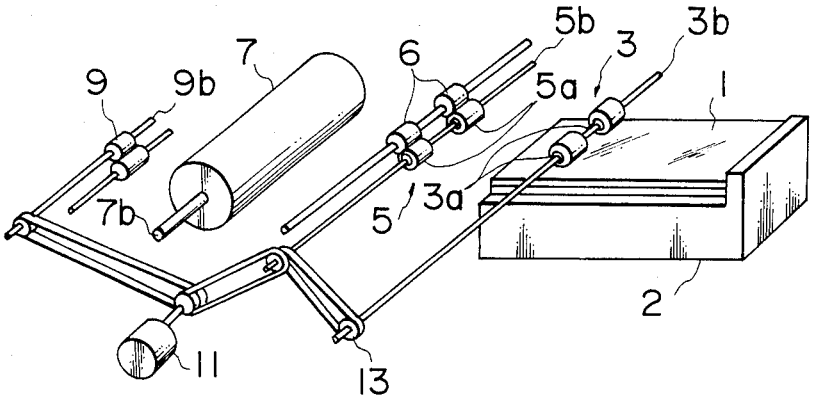
FIG. 3 is a perspective drawing of a further embodiment of the invention.
Figure 4:
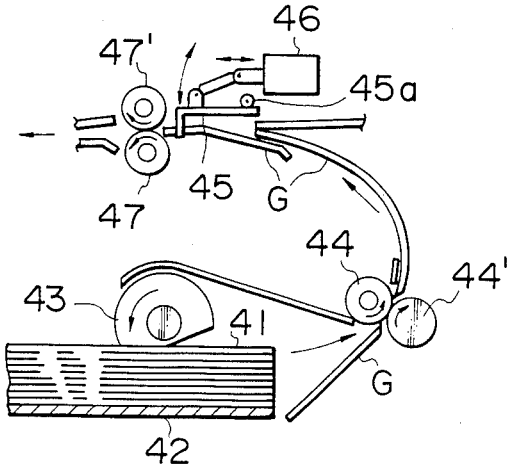
FIG. 4 PRIOR ART
FIG. 4 is a schematic representation of a conventional paper feeder.

Referring to FIG. 3, a further embodiment of the invention will be explained. The same numerals are applied to corresponding members of FIG. 3 and FIG. 2. In the embodiment of FIG. 3, the positions of the interposed roller 5 and the auxiliary roller 6 are "upside-down" compared with the respective positions of corresponding elements of the embodiment of FIG. 2. In the embodiment of FIG. 3, the rotational direction of the shaft **3*b* of the feed roller 3 is the same as the rotational direction of the shaft 5*b* of the interposed roller 5 since the gear 13 is driven by a timer belt about shaft 5*b* as FIG. 3 shows. In the embodiment of FIG. 3, the platen 7 is not driven by the motor 11** but by another motor (not shown). However, the same effectiveness will be expected and thereby further explanation is not necessary.

According to the invention therefore, an interposed roller 5 is substituted as a paper-positioner, and one-way clutches are inserted between the feed roller 3 and its shaft **3*b*, and the interposed roller 5 and its shaft 5*b***, and thus paper separation from the paper pile and paper feed are conducted smoothly, and the total cost of the office machine is reduced.

Note that although the invention has been described by way of reference to a dot printer, the invention can easily be adapted to a wide variety of printers, photocopiers or other types of equipment using sheets of material such as paper. Of course, sheets of other types of material, such as plastic, may be used with the invention.

As many widely different embodiments of the invention may be made without departing from the spirit and scope thereof, it should be understood that the invention is not limited to the specific embodiments herein described, but rather, should be interpreted by way of reference to the appended claims.

I claim:

1. A sheet feeder, comprising:

first rolling means for entering a sheet into a feeding course;

second interposed rolling means displaced from said first rolling means along said feeding course;

said first and second rolling means each being mounted on shafts provided with one-way clutch means; and common drive means for rotatably driving said shafts of said first and second rolling means such that rotation of said shafts in a first direction causes said first rolling means to feed a sheet to feeding course and said second rolling means to stop said sheet in rectitude and rotation of said shafts in a second direction causes said second rolling means to continue said sheet along said feeding course and said first roller means to stop.

2. A sheet feeder as recited in claim 1, wherein an auxiliary roller abuts said second interposed rolling means forming a wedge-shape therewith which partially defines said feeding course.

3. A sheet feeder, as recited in claim 1, wherein said drive means further rotatably drives a platen.

4. A sheet feeder, as recited in claim 3, provided in a dot printer.

* * * * *